US008246314B2

(12) United States Patent
Tanaka

(10) Patent No.: US 8,246,314 B2
(45) Date of Patent: Aug. 21, 2012

(54) ION PUMP DEVICE

(75) Inventor: Shukichi Tanaka, Koganei (JP)

(73) Assignee: National Institute Of Information And Communications Technology, Tokyo (JP)

( * ) Notice: Subject to any disclaimer, the term of this patent is extended or adjusted under 35 U.S.C. 154(b) by 224 days.

(21) Appl. No.: 12/527,193

(22) PCT Filed: Feb. 14, 2008

(86) PCT No.: PCT/JP2008/000225

§ 371 (c)(1),
(2), (4) Date: Sep. 9, 2009

(87) PCT Pub. No.: WO2008/099610

PCT Pub. Date: Aug. 21, 2008

(65) Prior Publication Data

US 2010/0143159 A1 Jun. 10, 2010

(30) Foreign Application Priority Data

Feb. 16, 2007 (JP) ..... 2007-035568
Feb. 16, 2007 (JP) ..... 2007-035570

(51) Int. Cl.
*F04B 37/02* (2006.01)
*F04F 99/00* (2009.01)

(52) U.S. Cl. ..... 417/48; 417/234

(58) Field of Classification Search ..... 417/48, 417/49, 234; 118/500, 719
See application file for complete search history.

(56) References Cited

U.S. PATENT DOCUMENTS 3,228,590 A * 1/1966 Kearns et al. ..... 417/49
4,594,054 A * 6/1986 Ishimaru et al. ..... 417/49
5,324,950 A * 6/1994 Otaka et al. ..... 250/441.11
5,442,183 A * 8/1995 Matsui et al. ..... 250/441.11
6,835,048 B2 * 12/2004 Perkins et al. ..... 417/49

FOREIGN PATENT DOCUMENTS

JP 465057 A 3/1992
JP 7312202 A 11/1995
JP 2003-222574 A 8/2003

* cited by examiner

*Primary Examiner* — Devon Kramer
*Assistant Examiner* — Ryan Gatzemeyer
(74) *Attorney, Agent, or Firm* — Pyprus Pte Ltd

(57) ABSTRACT

An ion pump having a casing (1), a first electrode (2), a second electrode (3), a plurality of cylindrical magnets (4), and a connection part (5). The first electrode (2) is arranged inside the casing (1). The second electrode (3) is arranged on the outer circumference of the first electrode (2). The first electrode and the second electrode have different polarities. The cylindrical magnets (4) are arranged so as to surround the circumference of the second electrode (3). The plurality of cylindrical magnets (4) are arranged so as to surround the circumference of the second electrode (3). The plurality of cylindrical magnets (4) are arranged at intervals in the center axis direction of the casing (1).

11 Claims, 9 Drawing Sheets

Fig.1
Fig.1(a)
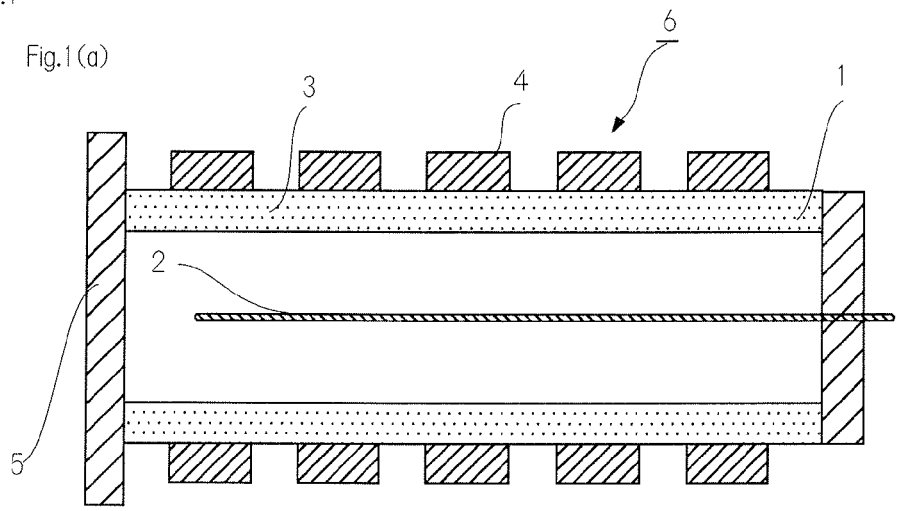
Fig.1(b)
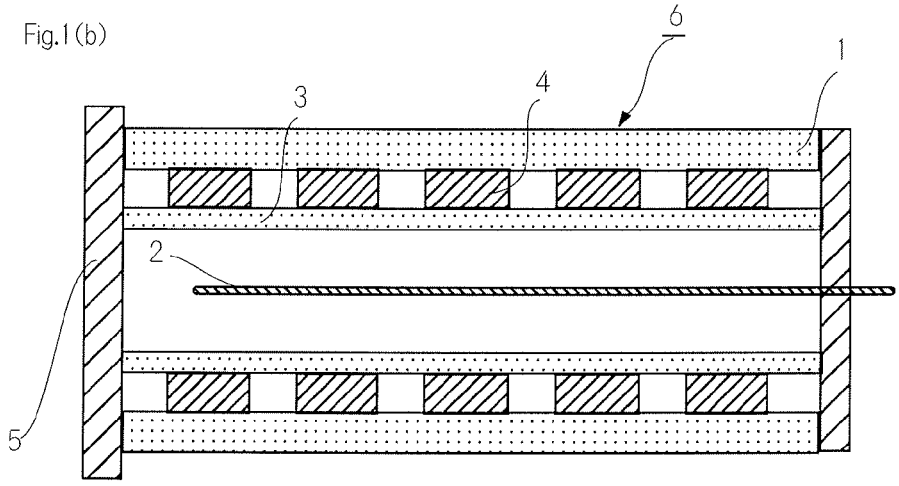
Fig.1(c)
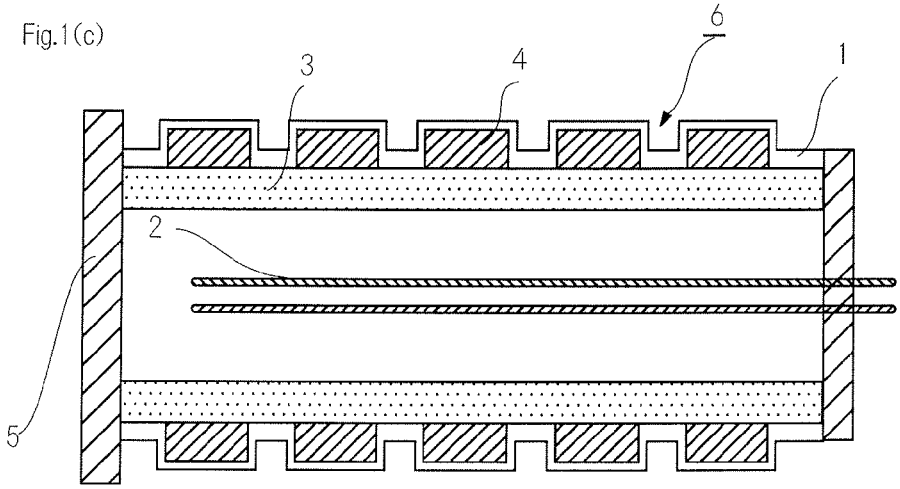

Fig.8
Fig.8(a)
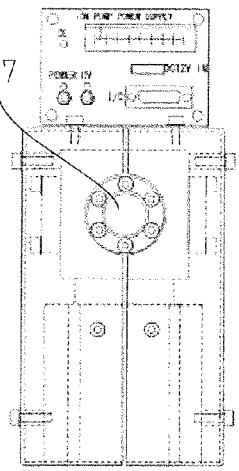
Fig.8(b)
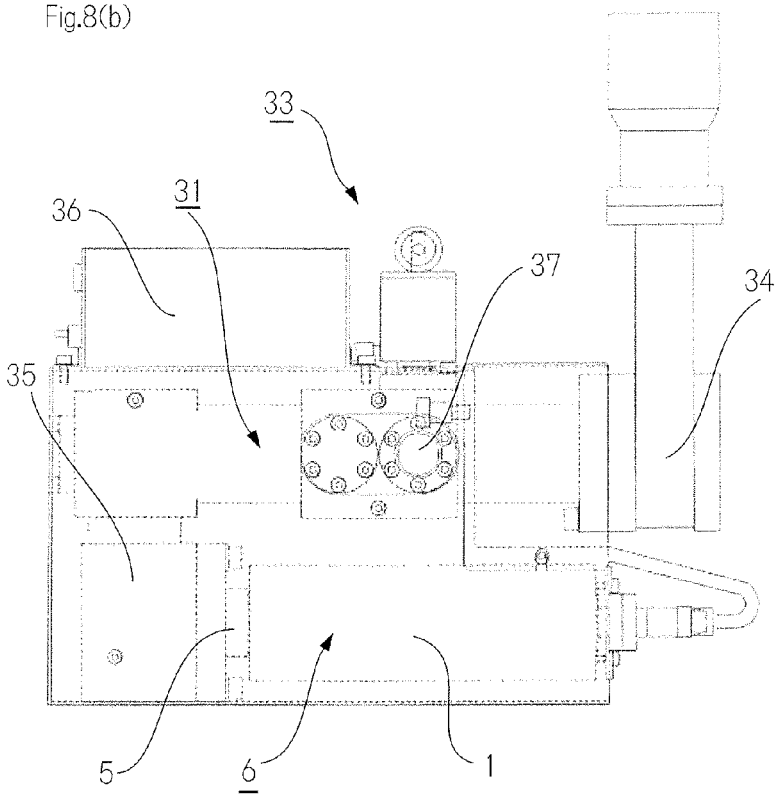

ION PUMP DEVICE

TECHNICAL FIELD

The present invention relates to an ion pump device etc. so miniaturized as to be carried by introducing three-dimensional magnetic fields.

BACKGROUND ART

With the development of nanotechnology and ultra-precision measuring technologies, ultrahigh vacuum technologies have been emphasized. Surfaces of semiconductors are subject to pollution by gas molecules. In contrast, by maintaining semiconductors in an ultrahigh vacuum below about $10^{-7}$ Pa, the surfaces of semiconductors can be kept clean. And pumps such as an ion pump are used to maintain an ultrahigh vacuum.

As shown in FIGS. 4(A) and 4(B) in Japanese Patent Application Laid-Open No. H9-27294, for example, conventional ion pumps have arranged tabular permanent magnets so as to face each other in parallel across a cuboid container. For this reason, the magnetic fields are unidirectional, and the spaces in the ion pumps have not been able to be effectively utilized.

In order to solve such a problem, "an ion pump comprising a first cylindrical electrode and a second cylindrical electrode in its circumference both arranged concentrically in a cylindrical casing, characterized in that a radial electric field generation means among each cylindrical surface of the said second cylindrical electrode, the first cylindrical electrode and the casing, and a magnetic field generation means parallel to the axis of the said first cylindrical electrode and the second cylindrical electrode are provided in the cylindrical casing" is disclosed in claim 1 in Japanese Patent Application Laid-Open No. H9-27294 (see Patent Document 1 below).

Furthermore, "a sputter ion pump comprising an anode electrode and a cathode electrode arranged in a vacuum chamber, wherein high voltage is applied between the anode electrode and cathode electrode so that electrons are spirally moved by means of a magnetic field, residual gas molecules are collided with electrons that are spirally moving and are ionized, and the ionized molecules sputter the cathode electrode to adsorb onto the surfaces of the anode electrode or the like, thereby performing an evacuation, characterized in that the cylindrical section of the vacuum chamber wall is formed to have a convex or concave cross-sectional profile, permanent magnets each having the same shape and character are located in the direction of the same magnetic pole in each concave portion outside the convex or concave cross-sectional profile, anode electrodes each of which is cylindrical are located apart from the vacuum chamber wall in each concave portion inside the convex or concave cross-sectional profile, the cylindrical portion of the vacuum chamber wall is constituted as a cathode electrode, a cylindrical magnetic shield member equipped with an exhaust hole circumferentially is arranged concentrically with the plurality of permanent magnets and the anode electrodes, and the plurality of permanent magnets and the anode electrodes are arranged at equal intervals axially opposite one another.

However, such ion pumps need to use many insulators such as ceramics in order to obtain insulation between electrodes. For this reason, there is a problem that gases are emitted from ceramics etc., lowering a degree of vacuum. There is also a problem that such ion pumps do not have enough strength.

Furthermore, such ion pumps are large and heavy, and their power consumption is also large. Therefore, there is a problem that once the conventional ion pumps are located they cannot be moved easily.

[Patent Document 1] Japanese Patent Application Laid-Open No. H9-27294

[Patent Document 2] Japanese Patent Application Laid-Open No. 2001-332209

DISCLOSURE OF THE INVENTION

It is an object of the present invention to provide a miniaturized ion pump.

It is an object of the present invention to provide a lightweight ion pump.

It is an object of the present invention to provide a portable ion pump.

It is an object of the present invention to provide a portable vacuum carrying device.

The present invention is basically based on a knowledge that by arranging a plurality of ring-like magnets in a row in the circumference of electrodes, three-dimensional magnetic fields can be obtained and ion pumps can be miniaturized as well.

The first aspect of the present invention relates to an ion pump comprising a casing (1), a first electrode (2), a second electrode (3), a plurality of cylindrical magnets (4), and a connection part (5). The first electrode (2) is provided inside the casing (1). The second electrode (3) is fixed on the inner wall of the casing (1). Also the second electrode (3) is located in the circumference of the first electrode (2). And the first electrode and the second electrode have different polarities. The cylindrical magnets (4) are located so as to surround the circumference of the second electrode (3). The magnets may be located outside the casing (1). The connection part (5) is a mechanism for connecting the casing (1) with other device. The plurality of cylindrical magnets (4) are located so as to surround the circumference of the second electrode (3). The plurality of cylindrical magnets (4) are located in a row at intervals in the central axis direction of the casing (1).

The ion pump fixes the second electrode (e.g., negative pole) to the inner wall of the casing, and locates the second electrode in the circumference of the first electrode (e.g., positive pole). And the ion pump locates the plurality of cylindrical magnets (4) so as to surround the circumference of the second electrode (3). In this way, three-dimensional magnetic fields can be obtained and ion pumps can be miniaturized as well. In an example of a preferred ion pump, the inner wall or the side wall of the casing concurrently serves as the second electrode. In this way, ion pumps can be miniaturized further. As an ion pump of the present invention is preferably portable, it is preferred to use batteries as a power supply. The DC voltage from batteries can be converted, using a converter suitably, to further high-voltage DC voltage or AC voltage for use.

In the present invention, the cylindrical magnets (4) are a plurality of cylindrical magnets located in a row at intervals in the central axis direction of the casing.

Magnets are generally heavy in weight. The ion pump of this mode, instead of using one cylindrical magnet, divides it into a plurality of cylindrical magnets and locates them at predetermined intervals. This can make the ion pump more lightweight and efficient magnetic fields can be obtained as well. Moreover, by using a plurality of small magnets easy to process instead of a large magnet hard to process, the difficulty in processing the shape or size of the pump casing is significantly improved.

The desirable mode of the first aspect of the present invention has a movement mechanism. The movement mechanism (14) moves the plurality of cylindrical magnets in the longitudinal direction of the casing (1). The movement mechanism (14) can change the region where magnetic fields concentrate. This can prevent the degradation of the system as well as improve the efficiency of the system. This configuration can be employed in any ion pump explained earlier. The movement mechanism may move magnets manually.

The desirable mode of the first aspect of the present invention relates to the cylindrical magnets which are removable from the casing (1). This ability to remove the cylindrical magnets improves productivity and makes maintenance easier.

The desirable mode of the first aspect of the present invention is configured so that the adjacent surfaces of the plurality of cylindrical magnets have the same polarities. And the ion pump of this mode further comprises magnetic materials between the adjacent magnets of the plurality of cylindrical magnets. The magnetic materials are arranged so that the magnetic poles going from the adjacent surfaces into the central axis direction of the casing (1) may be stronger. In this way, as the magnetic materials are located between the adjacent magnets, the spatial distribution of magnetic flux can be adjusted and the magnetic flux penetration into the electromagnetic direction can be promoted. These magnetic materials include a permanent magnet, an electromagnet, soft iron, iron, a ferrite, and the like, which have magnetic flux rectification effects. This configuration can be employed in any ion pump explained earlier.

This further arrangement of magnetic materials between magnets can strengthen the magnetic fields formed in the casing. This can improve the efficiency of the system.

In the desirable mode of the first aspect of the present invention, the casing (1) is the second electrode (3). That is, the desirable ion pump of the present invention uses the casing itself as the second electrode (3). More specifically, the ion pump uses the casing made of aluminum with titanium evaporated on the surface. The casing serves as the second electrode (3). This configuration can be employed in any ion pump explained earlier. This can make the ion pump more lightweight and also make it more miniaturized with the structure simpler.

In the desirable mode of the first aspect of the present invention, each element is rod-like or cylindrical. That is, the casing (1) is cylindrical. And the first electrode (2) is a rod-like electrode located on the central axis of the casing or a cylindrical electrode located concentrically to the casing. The second electrode (3) is a cylindrical electrode located concentrically to the casing. The cylindrical magnets (4), located concentrically to the casing, are cylindrical. This configuration can be employed in any ion pump explained earlier.

In this way, as each element is arranged concentrically, it is possible to generate ion etc. efficiently to trap gases.

The desirable mode of the first aspect of the present invention relates to an ion pump wherein one end of the first electrode (2) is fixed to the casing. This configuration can be employed in any ion pump explained before.

A common ion pump etc. use many ceramics etc. to insulate the second electrode from the first electrode. This mode of ion pump, as it fixes the first electrode to the casing, can effectively prevent the situation where the first electrode swings and contacts the second electrode while the ion pump is in operation. Therefore, it reduces the need of using many insulators such as a ceramics and can effectively increase the degree of vacuum.

In the desirable mode of the first aspect of the present invention, one end of the first electrode (2) is fixed to the casing. And a spacer (8) is located in the opposite region to the one end fixed to the casing. The spacer fixes the first electrode (2) to the casing. This configuration can be employed in any ion pump explained earlier.

A common ion pump etc. use many ceramics etc. as an insulation to insulate the second electrode from the first electrode. This mode of ion pump, as it fixes the first electrode to the casing, can effectively prevent the situation where the first electrode swings and contacts the second electrode while the ion pump is in operation. Therefore, it reduces the need of using many insulators such as a ceramics and can effectively increase the degree of vacuum. Furthermore, the first electrode is more firmly fixed by the spacer, which can further effectively prevent the situation where the first electrode swings and contacts the second electrode even while the ion pump is in operation.

The second aspect of the present invention relates to a vacuum carrying device. This vacuum carrying device comprises a sample room (31) and an ion pump (6). The sample room (31) comprises a gate part (34) into and from which samples are transferred and which can also be connected to other device, and a connection part (35) for connecting with the ion pump. And any ion pump as explained earlier can suitably be used as the ion pump (6).

The use of this vacuum carrying device will allow carrying the samples stored in the sample room while in a vacuum environment. Any ion pump of the first aspect and those apparent from them can suitably be used as an ion pump in the vacuum carrying device concerning the second aspect of the present invention.

According to the present invention, as electric fields are efficient three-dimensional electric fields and the second electrode is fixed to the inner wall of the casing, a miniaturized ion pump can be provided.

According to the present invention, as electric fields are efficient three-dimensional electric fields and a magnet is divided into a plurality of cylindrical magnets which are located at predetermined intervals, a lightweight ion pump with a simple structure can be provided.

According to the present invention, as a miniaturized and lightweight ion pump as mentioned above is available, a portable ion pump while in operation can be provided.

According to the present invention, a portable vacuum carrying device is provided.

BRIEF DESCRIPTION OF THE DRAWINGS

FIG. 1 shows a schematic view for explaining an ion pump of the present invention. FIG. 1(*a*) shows a sectional view of an ion pump wherein a casing concurrently serves as a second electrode. FIG. 1(*b*) shows a sectional view of an ion pump wherein a caging (1), cylindrical magnets (4), and a second electrode (3) are located in order from the external surface. FIG. 1(*c*) shows a sectional view of an ion pump wherein the caging has the portions in convex or concave shape for storing magnets where the magnets are located.

FIG. 8 shows a conceptual diagram for explaining a vacuum carrying device of the present invention. FIG. 8(*a*) shows a rear view and FIG. 8(*b*) shows a side view.

Figure 2:
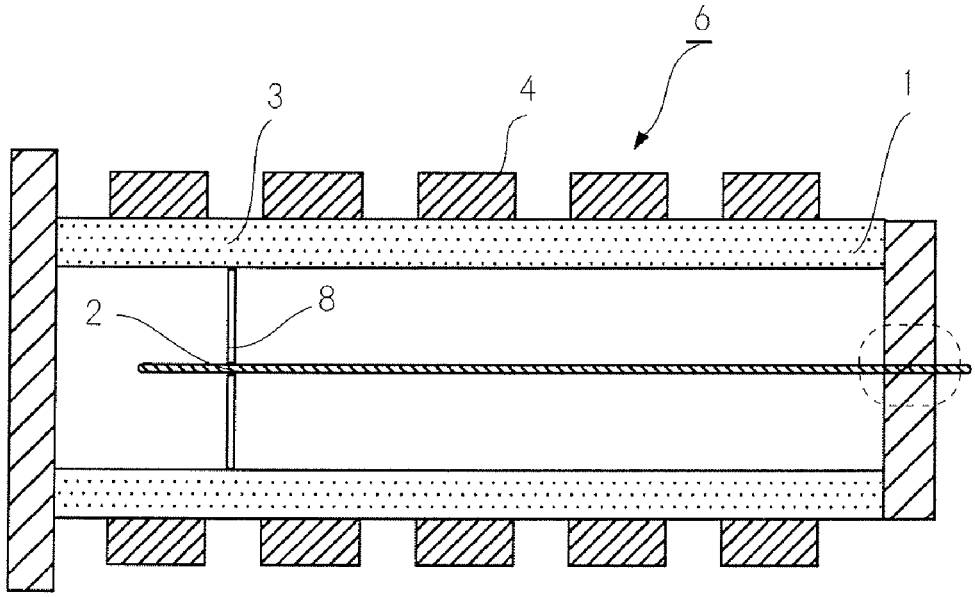
FIG. 2 shows the situation of a first electrode in an ion pump.

| Description of the Numerals | |
|---|---|
| 1 | Casing |
| 2 | First electrode |
| 3 | Second electrode |
| 4 | Magnets |
| 5 | Connection |
| 6 | Ion pump |

BEST MODE FOR CARRYING OUT THE INVENTION

Hereinafter, the best mode for carrying out the present invention will be described.

1. Ion Pump

FIG. 1 shows a schematic view for explaining an ion pump of the present invention. FIG. 1(*a*) shows a sectional view of an ion pump wherein a casing concurrently serves as a second electrode. FIG. 1(*b*) shows a sectional view of the ion pump wherein a caging (1), cylindrical magnets (4), and a second electrode (3) are located in order from the external surface. FIG. 1(*c*) shows a sectional view of an ion pump wherein the caging has the portions in convex or concave shape for storing magnets where the magnets are located. As shown in FIG. 1, an ion pump concerning the first aspect of the present invention relates to an ion pump comprising a casing (1), a first electrode (2), a second electrode (3), a plurality of cylindrical magnets (4), and a connection part (5). The first electrode (2) is provided inside the casing (1). The second electrode (3) is fixed on the inner wall of the casing (1). Also the second electrode (3) is located in the circumference of the first electrode (2). And the first electrode and the second electrode have different polarities. That is, one of the first electrode and the second electrode is a positive electrode and the other is a negative electrode. The cylindrical magnets (4) are located so as to surround the circumference of the second electrode (3). The magnets may be located outside the casing (1). The connection part (5) is a mechanism for connecting the casing (1) with other device.

The ion pump fixes the second electrode to the inner wall of the casing. Also the ion pump locates the second electrode in the circumference of the first electrode. Furthermore, the cylindrical magnets (4) surround the circumference of the second electrode (3). In this way, the ion pump can obtain three-dimensional magnetic fields and can be miniaturized as well. In case of a desirable ion pump, the inner wall or the side wall of the casing concurrently serves as the second electrode. Preferably, an ion pump of the present invention is portable. Thus it is preferred to use batteries as a power supply. The DC voltage from batteries can be converted, using a converter suitably, to further high-voltage DC voltage or AC voltage for use.

In a desirable ion pump of the present invention, the casing (1) is cylindrical. And the first electrode (1) is a rod-like electrode located on the central axis of the casing or a cylindrical electrode located concentrically to the casing. The second electrode (3) is a cylindrical electrode located concentrically to the casing. The cylindrical magnets (4), located concentrically to the casing, are cylindrical. Thus, as each element is arranged concentrically, it is possible to generate ion etc. efficiently to trap gases. Hereinafter, each element constituting the ion pump of the present invention will be explained.

Casing (1)

A casing is a frame of an ion pump. A variety of electrodes etc. can be formed inside the frame. Though magnets are usually located inside the casing, they may be located outside the casing. Well-known materials such as aluminum, titanium, stainless steel, or the like can be used as a material of the casing. Among these, aluminum with titanium evaporated on the surface is desirable. In case of the casing made of aluminum with titanium evaporated on the surface, the inner wall itself of the casing can be used as the second electrode. This can make the ion pump more lightweight and also make it more miniaturized with the structure simpler. In contrast, the second electrode and the casing may be located concurrently, a plurality of magnets may be located in the space between them, and a second electrode fixation part for connecting the second electrode with the casing may be located between the plurality of magnets, for example. Then, the second electrode can effectively be fixed with the casing.

First Electrode (2)

Well-known materials can suitably be employed as a material used for the first electrode. Preferably, the first electrode (1) is a rod-like electrode located on the central axis of the casing or a cylindrical electrode located concentrically to the casing. The first electrode is a positive electrode, for example. However, it may be a negative electrode. The desirable mode of the present invention comprises a polarity control device which can change the polarity of the first electrode.

FIG. 2 shows the status of the first electrode in the ion pump. As shown in FIG. 2, in a desirable ion pump, one end of the first electrode (2) is fixed to the casing (1). In FIG. 2, the one end of the first electrode is fixed to the end surface of the casing in the region shown by a dotted line. And, a spacer (8) is located in the region of the first electrode (2) opposite to the one end fixed to the casing. The first electrode is fixed to the casing through the spacer. The spacer for fixing the first electrode (2) to the casing is for fixing the portion not fixed to the casing of the first electrode with the casing or the second electrode. This can prevent the end of the first electrode from swinging. Specific spacers include a plurality of linear spacers extending from the first electrode to the second electrode or the casing, like a spoke of wheel supposing that the first electrode is a hub.

A common ion pump uses a ceramics etc. to insulate the second electrode from the first electrode. The desirable ion pump of the present invention fixes the first electrode to the casing. In this way, the ion pump of the present invention can effectively prevent the situation where the first electrode swings and contacts the second electrode while the ion pump is in operation. Therefore, it reduces the need of using many insulators such as a ceramics and can effectively increase the degree of vacuum. Furthermore, the first electrode is more firmly fixed by the spacer, which can further effectively prevent the situation where the first electrode swings and contacts the second electrode even if external vibration, shock etc. are caused while the ion pump is in operation.

Second Electrode (3)

Well-known materials can suitably be employed as a material used for the first electrode. Preferably, the second electrode (3) is a cylindrical electrode located concentrically to the casing. The second electrode has a different polarity from the first electrode. That is, if the first electrode is positive, the second electrode is negative.

Cylindrical Magnets (4)

In the present invention, a plurality of cylindrical magnets are used which are located in a row at intervals in the central axis direction of the casing. In the present invention, it is preferred to use a plurality of ring-like permanent magnets in a row. Preferably, each of these ring-like permanent magnets has the same width. Also, the ring-like permanent magnets are preferably arranged at equal intervals. The ion pump of this mode, instead of using one cylindrical magnet, divides it into a plurality of cylindrical magnets and locates them at predetermined spaces, which can make the ion pump more lightweight and efficient magnetic fields can be obtained as well. Electromagnets can be used instead of the permanent magnets.

Figure 3:
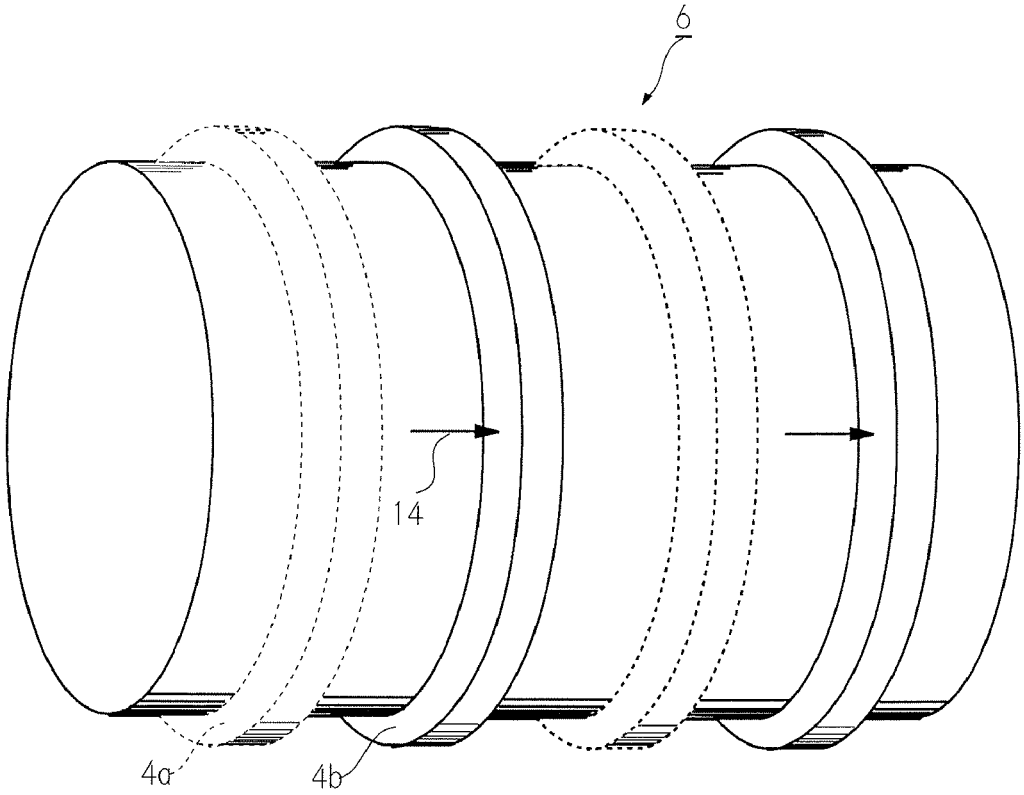
FIG. 3 shows a conceptual diagram of an ion pump having a movement mechanism.

The desirable mode of the first aspect of the present invention relates to any ion pump as described above, which further has a movement mechanism (14) moving a plurality of cylindrical magnets in the longitudinal direction of the casing (1), as shown in FIG. 3. This movement mechanism (14) can change the region where the magnetic fields concentrate, which can prevent the degradation of the system as well as improve the efficiency of the system. The movement mechanism may move magnets manually.

The desirable mode of the first aspect of the present invention relates to the cylindrical magnets which are removable from the casing (1). This ability to remove the cylindrical magnets improves productivity and makes maintenance easier.

FIG. 3 shows a conceptual diagram of an ion pump having a movement mechanism. That is, the ion pump of this mode has a movement mechanism for moving magnets from the location where magnetic fields are strong to the location where magnetic fields are weak. This can move magnets from the pre-movement state (4*a*) to post-movement state (4*b*). More specifically, the plurality of cylindrical magnets are united and are located so that they can slide in advance. And an actuator is connected to the plurality of cylindrical magnets. The actuator is connected to a control part. And the control part instructs the actuator to move the cylindrical magnets. Then, the actuator moves the cylindrical magnets by a predetermined amount. As a result, the cylindrical magnets can be moved by a predetermined amount.

Figure 4:
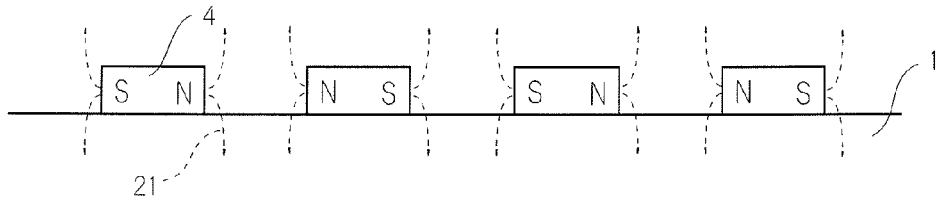
FIG. 4 shows a conceptual diagram showing the magnetic fields with external magnets in an ion pump having the fixed external magnets.

FIG. 4 shows a conceptual diagram showing the magnetic fields with external magnets in an ion pump having the fixed external magnets. The magnetic fields are denoted by numeral 21 in the figure. As shown in the FIG. 4, when the external magnets are fixed, the magnetic fields begin to leak not only to the internal of the casing but to the external of the casing.

Figure 5:
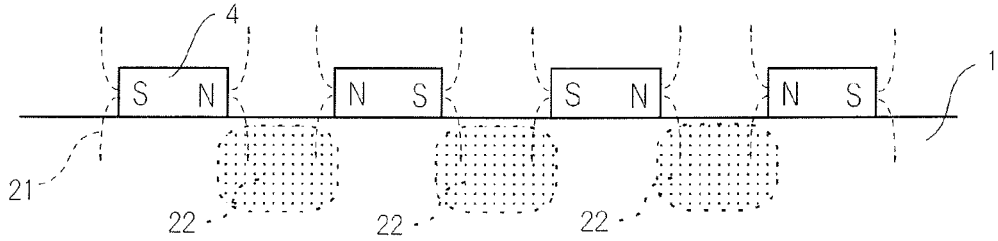
FIG. 5 shows a conceptual diagram showing the portions where magnetic fields with external magnets concentrate in an ion pump having the fixed external magnets.

FIG. 5 shows a conceptual diagram showing the portions where magnetic fields with external magnets concentrate in an ion pump having the fixed external magnets. As shown in FIG. 5, in an ion pump having fixed external magnets, magnetic fields concentrates on the portions denoted by numeral 22. That is, in an ion pump having fixed external magnets, getter surfaces concentrate and thus vacuum efficiency degrade earlier. Furthermore, as getter surfaces concentrate, this ion pump can deteriorate earlier.

Figure 6:
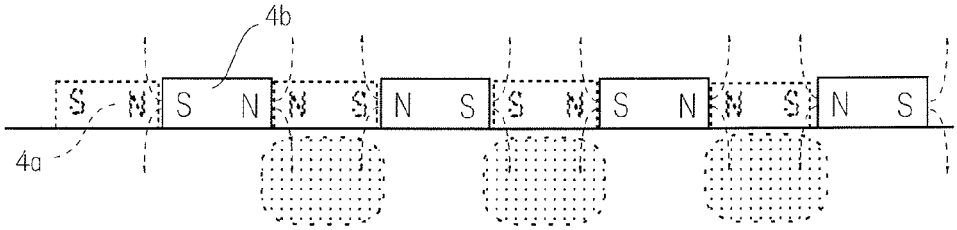
FIG. 6 shows a conceptual diagram showing the magnetic fields with external magnets after moving magnets using a movement mechanism.

FIG. 6 shows a conceptual diagram showing magnetic fields with external magnets after moving magnets using a movement mechanism. As shown in FIG. 6, the use of a movement mechanism can shift the location where magnetic fields concentrate. This enables molecules to be adsorbed to the surfaces where molecules are not adsorbed, which can improve adsorption efficiency. As explained earlier, an example of the movement mechanism applies a force to the permanent magnets—a plurality of cylindrical magnets connected together—using an actuator, and changes the locations of the plurality of cylindrical magnets.

The desirable mode of the first aspect of the present invention is configured so that the adjacent surfaces of the plurality of cylindrical magnets have the same polarities. And the ion pump of this mode further comprises magnetic materials between the adjacent magnets of the plurality of cylindrical magnets. The magnetic materials are arranged so that the magnetic poles going from the adjacent surfaces into the central axis direction of the casing (1) may be stronger. In this way, as the magnetic materials are located between the adjacent magnets, the spatial distribution of magnetic flux can be adjusted and the magnetic flux penetration into the electromagnetic direction can be promoted. These magnetic materials include a permanent magnet, an electromagnet, soft iron, iron, a ferrite, and the like, which have magnetic flux rectification effects.

Figure 7:
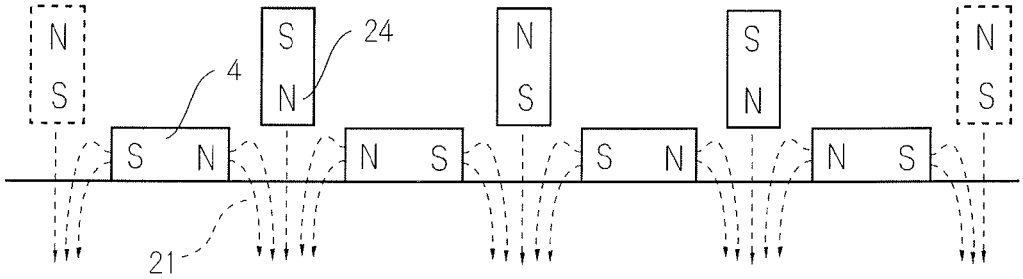
FIG. 7 shows a conceptual diagram showing magnetic fields with external magnets in an ion pump including magnetic materials between the adjacent magnets.

FIG. 7 shows a conceptual diagram showing magnetic fields with external magnets in an ion pump including magnetic materials between the adjacent magnets. In FIG. 7, magnets are used as an example of magnetic materials. As shown in FIG. 7, this ion pump can more strengthen the magnetic fields formed in the casing by arranging further magnets between external cylindrical magnets (4). This can improve the system efficiency. The magnets arranged between the magnets may be cylindrical magnets.

For example, if the adjacent cylindrical magnets (4) are arranged turning N poles to each other, magnet fields of N poles are formed between the cylindrical magnets. Next, further magnets are located between and above these adjacent cylindrical magnets. The magnets (24) between the cylindrical magnets are located so that their lower sides turn to N pole. In this way, the magnetic fields with N poles formed by the adjacent cylindrical magnets (4) can be strengthened. Preferably, the magnets between the cylindrical magnets are also cylindrical or ring-like. Preferably, the ring-like magnets are located between the adjacent cylindrical magnets and also have a larger diameter than that of the cylindrical magnets.

Connection Part (5)

A connection part (5) is a portion for connecting a casing with other device. "Other device" includes a vacuum chamber, a sample room, etc. in which a vacuum state is to be created. A specific connection part (5) is a flange.

Ion Pump (6)

The operating principle of an ion pump is well-known. The operating principle of an ion pump is briefly explained below. When the voltage of about several kilovolts is applied to and between a second electrode and a first electrode of an ion pump, primary electrons are emitted from the second electrode. As the primary electrons emitted from the second electrode are drawn to the first electrode and yet are influenced by the magnetic fields from permanent magnets, they circle following a long spiral path to reach the first electrode. On the way, the primary electrons cause ionization crashes with neutral gas molecules, and generate many positive ions and secondary electrons. The generated secondary electrons further follow a spiral path, cause crashes with other gas molecules, and generate positive ions and electrons. Then the ions etc. are adsorbed to the electrode.

The ion pumps concerning the present invention can suitably use the well-known configurations used for ion pumps in addition to the above. For example, a heater, a cooler, etc. may be attached suitably. Cooling with a cooler can improve the trapping efficiency of gasses. In contrast, heating with a heater can maintain a vacuum state and emit the gasses trapped by the electrode.

2. Vacuum Carrying Device

FIG. 8 shows a conceptual diagram for explaining a vacuum carrying device of the present invention. FIG. 8(*a*) shows a rear view and FIG. 8(*b*) shows a side view. As shown in FIG. 8, the vacuum carrying device (33) concerning the second aspect of the present invention comprises a sample room (31) and an ion pump (6). The sample room (31) comprises a gate part (34) into and from which samples are carried and which can also be connected to other device, and a connection part (35) for connecting with the ion pump. And any ion pump as explained earlier can suitably be used as the ion pump (6). In the figure, numeral 36 refers to a power supply (battery) and numeral 37 refers to a viewport.

By using this vacuum carrying device, the samples stored in the sample room can be carried while in a vacuum environment. That is, "a portable vacuum carrying device" means a carrying device which can be moved while an ion pump is in operation. The ion pumps of the first aspect and those apparent from them can be used suitably as an ion pump in the vacuum carrying device concerning the second aspect.

A sample stand, for example, is located in the sample room (31) and samples are fixed to it. And the atmosphere where the samples are located is maintained in a vacuum state by an ion pump. The sample room is a vacuum chamber etc. A gate part (34) is a gate valve for example. This allows maintenance of a vacuum state and opening/closing of the sample room, and, in addition, connection to other vacuum device while maintaining the vacuum state in the sample room. A connection part (35) is not specifically limited as far as it can connect the sample room with an ion pump while maintaining the vacuum state in the sample room. Well-known batteries can be used suitably as a power supply (36). Although a viewport (37) is arbitrary, the inside of the chamber can be seen through the viewport. Moreover, observations/experiments can be conducted using the viewport (37). Furthermore, by locating a feed-through (current introduction terminal), resistance measurements can be conducted and samples can be heated as well.

Though not particularly illustrated, an opening may be located between ring-like magnets, and the opening may be connected with other target systems such as a vacuum chamber etc. in which a vacuum is to be created, and these plurality of target systems may be maintained in a vacuum state. The introduction of such a configuration enables a plurality of targets to be easily maintained in a vacuum. In particular, when carrying a plurality of target systems which do not need to be maintained in an ultrahigh vacuum, such a system can be used effectively.

Embodiment 1

Figure 9:
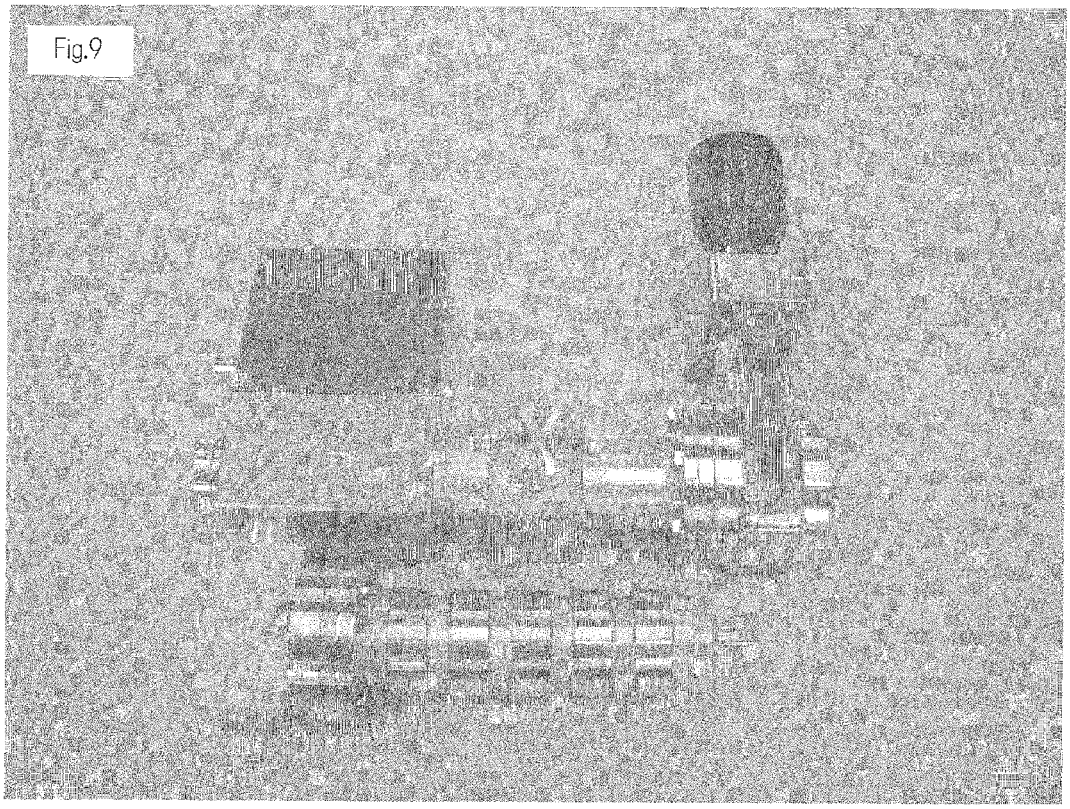
FIG. 9 is a photograph replacing a drawing showing the actually manufactured vacuum carrying device.

Prototypes of an ion pump and a vacuum carrying device concerning the present invention were manufactured. FIG. 9 is a photograph replacing a drawing showing the actually manufactured vacuum carrying device.

In this ion pump, five ring-like permanent magnets are located at equal intervals in the circumference of the casing which concurrently serves as the second electrode. In this vacuum carrying device, the frame was formed with aluminum having aluminum oxide film. Moreover, in another vacuum carrying device, the frame was formed with titanium having titanium dioxide film. A 2.75" gate valve having a 1.33" routing port was used as a gate valve. An up-and-down clamp having a bellow was used as a sample lock. Batteries were used as a power supply. Moreover, a vacuum meter was located for measuring the degree of vacuum in the sample room This vacuum carrying device could locate samples with a maximum diameter of 35 mm. Moreover, high vacuum with internal pressure of $1\times10^{-6}$ Pa or less could be attained. Continuous operation for fifteen hours could be maintained while maintaining the vacuum continuously. The total weight was about 10 kg.

INDUSTRIAL APPLICABILITY

As an ion pump and a vacuum carrying device of the present invention are miniaturized and lightweight, they can be used suitably in the vacuum process industry.

As a vacuum carrying set of the present invention can carry experimental samples, samples, etc. while maintaining a vacuum state, it can be used suitably in the transportation industry as well.

The invention claimed is:

1. An ion pump comprising:

a casing (1);

a first electrode (2) provided inside the casing (1);

a plurality of cylindrical magnets (4) fixed to the casing, which are located in a row at intervals in the central axis direction of the casing (1);

a second electrode (3) arranged between the first electrode (2) and the plurality of cylindrical magnets (4), which has a different polarity from that of the first electrode (2); and a connection part (5) for connecting the casing (1) with other devices, wherein the plurality of cylindrical magnets are configured so that the surfaces of the adjacent cylindrical magnets have the same polarities, wherein each of the surfaces of the adjacent cylindrical magnets are North pole or South pole.

2. The ion pump as claimed in claim 1, further comprising a movement mechanism (14) for moving the plurality of cylindrical magnets, which moves the plurality of cylindrical magnets in the longitudinal direction of the casing (1).

3. The ion pump as claimed in claim 2, wherein the cylindrical magnets (4) can be removed from the casing (1).

4. The ion pump as claimed in claim 1, further comprising magnetic materials between the adjacent magnets of the plurality of cylindrical magnets, wherein the magnetic materials are arranged so that the magnetic fields, formed by the adjacent magnets and going from the adjacent surfaces into the central axis direction of the casing (1), may be stronger.

5. The ion pump as claimed in claim 1, wherein the casing (1) concurrently serves as the second electrode (3).

6. The ion pump as claimed in claim 1, wherein the casing is made of aluminum with titanium evaporated on the surface and serves as the second electrode (3).

7. The ion pump as claimed in claim 1, wherein the casing (1) is cylindrical;

wherein the first electrode (1) is a rod-like electrode located on the central axis of the casing or a cylindrical electrode located concentrically to the casing (1);

wherein the second electrode (3) is a cylindrical electrode located concentrically to the casing; and wherein the cylindrical magnets (4) are located concentrically to the casing (1).

8. The ion pump as claimed in claim 1, wherein one end of the first electrode (2) is fixed to the casing (1).

9. The ion pump as claimed in claim 1, wherein one end of the first electrode (2) is fixed to the casing (1), and a spacer (8) for fixing the first electrode (2) to the casing (1) is provided in the region opposite to the one end fixed to the casing (1).

10. A vacuum carrying device comprising a sample room for storing samples and an ion pump for vacuumizing the inside of the sample morn, which can be carried while the ion pump is in operation, the sample room comprising:

a gate part into and from which samples are carried and which can also be connected to other devices; and an ion pump connection part (35) for connecting with the ion pump; and the ion pump comprising:

a casing (1);

a first electrode (2) provided inside the casing (1);

a second electrode (3) fixed to the inner wall of the casing (1), which is located between the casing and the first electrode (2) and has a different polarity from that of the first electrode; and cylindrical magnets (4) located so as to surround the circumference of the second electrode (3), which are located in a row at intervals in the central axis direction of the casing (1), wherein the cylindrical magnets are configured so that the surfaces of the adjacent cylindrical magnets have the same polarities, wherein each of the surfaces of the adjacent cylindrical magnets are North pole or South pole.

11. An ion pump comprising:

a casing (1);

a first electrode (2) provided inside the casing (1);

a second electrode (3) fixed to the inner wall of the casing (1) and located in the circumference of the first electrode (2), which has a different polarity from that of the first electrode (2);

a plurality of cylindrical magnets (4) located so as to surround the circumference of the second electrode (3), which are located in a row at intervals in the central axis direction of the casing (1); and a connection part (5) for connecting the casing (1) with other devices, wherein the plurality of cylindrical magnets are configured so that the surfaces of the adjacent cylindrical magnets have the same polarities, wherein each of the surfaces of the adjacent cylindrical magnets are North pole or South pole.

* * * * *